US009932162B2

(12) United States Patent
Stack, Jr.

(10) Patent No.: US 9,932,162 B2
(45) Date of Patent: Apr. 3, 2018

(54) PACKAGING ARTICLE AND METHOD

(71) Applicant: Steven Michael Stack, Jr., Watertown, CT (US)

(72) Inventor: Steven Michael Stack, Jr., Watertown, CT (US)

( * ) Notice: Subject to any disclaimer, the term of this patent is extended or adjusted under 35 U.S.C. 154(b) by 496 days.

(21) Appl. No.: 14/423,669

(22) PCT Filed: Aug. 27, 2013

(86) PCT No.: PCT/US2013/056919
§ 371 (c)(1),
(2) Date: Feb. 24, 2015

(87) PCT Pub. No.: WO2014/032059
PCT Pub. Date: Feb. 27, 2014

(65) Prior Publication Data

US 2015/0314936 A1 Nov. 5, 2015

Related U.S. Application Data

(60) Provisional application No. 61/743,064, filed on Aug. 27, 2012.

(51) Int. Cl.
*B65D 65/24* (2006.01)
*B65D 75/14* (2006.01)
(Continued)

(52) U.S. Cl.
CPC ..... *B65D 75/14* (2013.01); *B65D 5/5016* (2013.01); *B65D 5/5021* (2013.01);
(Continued)

(58) Field of Classification Search
CPC .... B65D 75/14; B65D 5/5016; B65D 5/5021; B65D 5/5035; B65D 65/24; B65D 65/40
(Continued)

(56) References Cited

U.S. PATENT DOCUMENTS 5,287,968 A * 2/1994 Ridgeway ..... B65D 81/075 206/583
5,678,695 A * 10/1997 Ridgeway ..... B65D 5/5028 206/305
(Continued)

FOREIGN PATENT DOCUMENTS

JP 2007022608 A 2/2007
JP 2008087837 A 4/2008
(Continued)

OTHER PUBLICATIONS

CN2013800546048 Search Report.
EPO 13830762.4 Search Report.

*Primary Examiner* — King M Chu
(74) *Attorney, Agent, or Firm* — Damian Wasserbauer, Esq.; Wasserbauer Law LLC

(57) ABSTRACT

An article of packaging, assembly and a method of manufacturing packaging for holding an object securely by a web or extensible portion formed in a single piece foldable member adapted to insert into a container or formed as an overlap panel to the container contiguous pattern. The foldable member has a planar structure with an upper surface and a lower surface. The pattern includes a platform portion, one or more side panel (s), and a web section in a predefined tessellation pattern. The web section is either integral to the pattern, or a separate web section. The web section is aligned to overlie the planar surface and is attached by an attachment portion to secure the web section to said side panels. In operation, the object is held securely in three-dimensions between the web section and the upper surface of the platform portion when the side portions are folded in a direction away from the web section thereby tightening the web section against the object between the web section and the platform portion.

52 Claims, 17 Drawing Sheets

(51) Int. Cl.
*B65D 65/40* (2006.01)
*B65D 81/07* (2006.01)
*B65D 5/50* (2006.01)

(52) U.S. Cl.
CPC ..... *B65D 5/5035* (2013.01); *B65D 65/24* (2013.01); *B65D 65/40* (2013.01); *B65D 81/07* (2013.01); *B65D 81/075* (2013.01)

(58) Field of Classification Search
USPC ..... 206/583, 521
See application file for complete search history.

(56) References Cited

U.S. PATENT DOCUMENTS

| | | | | |
|---|---|---|---|---|
| 7,296,681 | B2 * | 11/2007 | McDonald | B65D 5/5021 206/521 |
| 2004/0154951 | A1 * | 8/2004 | Hartung | B65D 81/1275 206/521 |
| 2008/0110788 | A1 * | 5/2008 | Keiger | B65D 5/5028 206/497 |
| 2010/0089779 | A1 * | 4/2010 | Bowers | A45C 7/0095 206/320 |
| 2011/0024324 | A1 * | 2/2011 | Tanner | B65D 81/075 206/588 |
| 2011/0120899 | A1 * | 5/2011 | Sorensen | B65D 81/03 206/522 |

FOREIGN PATENT DOCUMENTS

| | | | |
|---|---|---|---|
| JP | 201184107 | A | 9/2011 |
| WO | 9918009 | A1 | 4/1999 |

* cited by examiner

PACKAGING ARTICLE AND METHOD

CROSS-REFERENCE TO RELATED APPLICATION

This application claims the benefit of and is application is the 371 National Stage of International Application No. PCT/US2013/056919 filed on Aug. 27, 2013, which is a continuation of U.S. Provisional Patent Application No. 61/743,064 filed on Aug. 27, 2012, which are incorporated by reference in their entity.

FIELD OF THE INVENTION

The present invention relates to a packaging article, assembly, and method of manufacturing, that permits displacement of an article relative to the walls of packaging to protect from repeated shock and vibration and, in particular, to the packaging structures that eliminate the need for plastics or sheets of film in the construction thereof.

BACKGROUND ART

Protective packaging devices are used to protect articles and goods from shock and vibration during the transportation thereof. Corrugated boxes are designed to meet the particular needs of the product being shipped, the hazards of the shipping environment, (shock, vibration, compression, moisture as well as the needs of retailers and consumers. Articles and goods are shipped typically in a corrugated box with void-filling packaging including bubble wrap, Styrofoam®, paper, popcorn/peanut-shaped cushioning, and the like. While the corrugated box can be recycled, the void-filling packaging often becomes waste with associated problems of recycling and disposal. As a result, a need exists for protective packaging devices that can be easily recycled, do not contribute to waste problems, and that protect articles and goods in transit.

Conventional packaging systems have been developed to reduce the need for void-filling packaging when shipping using a corrugated box. These packaging systems hold an object securely against a substantially rigid panel by a flexible plastic film material superimposed on one surface panel by glue strips or, alternatively, by using a pocketed film sleeve. The panel has fold lines that cooperate with the film material to secure the object to the rigid panel when the side portions are folded in a direction away from the film, thereby tightening the film against the object placed between the film and the panel. Panels with pocketed film sleeves are sold under the mark TenxionPax® and manufactured by ClearPak LLC, for example, as illustrated in U.S. Pat. Nos. 6,675,973 B1, 7,296,681B2, 7,731,032 B2, 7,743,924 B2, 7,753,209 B2 and 7,775,367. Elastomeric polymer plastic film blends are illustrated in U.S. Pat. Nos. 5,678,695, 6,010,006, 6,148,590, 6,148,591, 6,289,655, 6,311,844, 6,289,655, 6,913,147, and 7,086,534 as manufactured by Sealed Air Corporation.

SUMMARY OF THE INVENTION

While conventional packaging systems are useful for securing objects, for example, in the return and repair of products such as, for example, computers, phones, disk drives, tablets and the like, these systems use costly elements such as costly polymer-film blends that stretch under tension and return to substantially the same size, i.e. have a memory. The plastic film element is a relatively expensive element and adds to the cost of such packaging systems. Moreover, conventional plastic films are not biodegradable and amount to additional waste. Therefore, there is a need to eliminate elastomeric polymer-film blends, and the associated cost, and use corrugate board, corrugate plastic, or a film membrane such as dense paper, common plastic films, heavy weight paper, recycled paper with a higher thickness density and/or rigidity, including biodegradable blends so as to improve the packaging system.

The solution is an article of packaging, and a method of manufacturing the article of packaging, with an adaptive web section utilizing a predefined tessellation pattern for holding an object securely in multiple dimensions. The predefined tessellation pattern can be incorporated into a separate sheet, an overlap portion, or the upper surface of a platform, as well as can be formulated to the three dimensional object shape. In other embodiments, an expandable pattern can be formed integral to the upper surface of a platform and or an overlap portion so as to expand and secure an object therein.

The article comprises a single piece foldable member having a planar structure that has an upper surface and a lower surface. The foldable member can be a container or insert and formed from a contiguous predefined pattern, or from one or more components. The pattern configures a platform portion, one or more side panel (s), and a web section in a predefined tessellation pattern. The web section is either integral to the pattern, or a separate section. The web section aligned to overlie the planar surface and is attached by an attachment portion to secure the web section to said side panels. In operation, the object is held securely in three-dimensions between the web section and the upper surface of the platform portion when the side portions are folded in a direction away from the web section thereby tightening the web section against the object between the web section and the platform portion.

SUMMARY OF THE INVENTION

It is an object of the present invention to provide a packaging article and holding substrate that is used to make the container and internal structure all comprising the packaging article can be utilized in a way that provides the same benefits and utility that plastic film provides in cradle and retention type packaging products commonly known and in the market place.

It also is an object of the present invention to provide an article, system and method of (1) incorporating the packaging structure integral to the container used to house securely the object secured within the packaging structure.

It is an object of the present invention to provide an article, system and method of (2) incorporating the packaging structure into an insert for a container.

It is an object of the present invention to provide a packaging structure for containers with additional applications, laminations, coatings and modifications to the semi-rigid planar material used to construct packaging structure are possible and are claimed. For example a high energy surface friction coating applied over the portions of the Packaging Structure that come in contact with an object to be secured within the Packaging Structure provides a surface that prevents objects from sliding or moving across the surfaces of the Packaging Structure when they are secured within, but not limited to. Other applications such as cohesive and adhesives could be utilized as well, but not limited to.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 78:
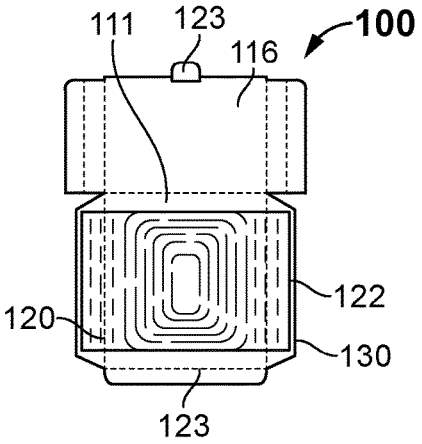
FIG. 78 illustrates the folded packaging box of FIG. 77.

Non-limiting embodiments of the present invention will be described below with reference to the accompanying drawings FIGS. 1-78, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or articles for achieving the desired function and that one skilled in the art could select from these or their equivalent in view of the disclosure herein and use of the term "means" is not intended to be limiting.

In the following detailed description, terms of orientation such as "upper," "lower," "longitudinal," "horizontal," "vertical," "lateral," "midpoint" and "end" are used herein to simplify the description in the context of the illustrated embodiments. Because other orientations are possible, however, the present invention should not be limited to the illustrated orientations. Additionally, the term suspension is not intended to require that anything, such as an article to be packaged, is suspended above anything. Rather, the term suspended as used herein, is only intended to reflect that such an article is held in a position spaced from another member, such as at least one of the walls of a container or box. Those skilled in the art will appreciate that other orientations of various components described herein are possible.

As used herein the term "corrugated" refers to a series of parallel ridges and furrows that can be incorporated into a material such as paper to manufacture corrugated board and containers therefrom. As used herein the term "corrugated box" is a container manufactured from the corrugated material. Paper-based corrugated materials consist essentially of a fluted corrugated sheet and one or two flat linerboards as is widely used in the manufacture of corrugated boxes and shipping containers using flute lamination machines as well as double wall corrugated fiberboard as is advantageous in certain applications.

In certain applications, corrugated plastic is desired, for example, performance under adverse weather conditions, where a product component can be exposed to harsh chemicals, where bacteria or other pathogens are a concern for medical applications, or where designs require that oils, solvents and water have no effect at regular temperatures. In these applications, corrugated plastic material is extruded in a twin-wall-plastic-sheet with a similar make-up to corrugated fiberboard can be used to form the container.

For the purpose of the present invention, the term "container" and the term "box" are used interchangeably, and are inclusive of other materials that can be sourced to make the structure referred container individually or incorporated in the disclosed inventions design as a structure constituting at least six side walls that effectively encompasses object(s) secured within and packaging structures within said walls from the outside world.

For the purpose of the present invention, the terms "assemble" and "assembled" are used interchangeably and mean a fully constructed packaging structure that has been manipulated to its final form from its starting form present to the user after constructed in the manufacturing process.

For the purpose of the present invention, the term "user" refers to the person directly or indirectly through fixtures of mechanisms manipulates the portions and features of a packaging structure to secure an object within said packaging structure for shipment from its presented state prior to assembly to completely assemble.

For the purpose of the present invention, the term "constructed" refers to the complete manufactured state of a packaging structure as it would be presented to a user and prior to be assembled.

For the purpose of the present invention, the term "retention style packaging structure" refers to a form of the present invention that retains an object against a semi-rigid planar surface with an expandable web mesh of the same or similar material.

For the purpose of the present invention, the term "integrated container style packaging structure" refers to a version of the disclosed novel technology that incorporates the a container into the disclosed features where the packaging structure is composed and constructed of one or more components all constituting the embodiment of the disclosed technology wholly referred to as Packaging Structure(s).

For the purpose of the present invention, the term "double sided suspension style packaging structure" or "suspension style" is used interchangeably to describe the method and designs of the disclosed Packaging Structure technology of encapsulating one or more objects between one or more webs so as to effectively suspend in a void of space. For the purpose of the present invention, the term "web" refers to any arrangement of slits and patterns of slits made in a semi rigid planar structure in such a way that allows the semi rigid planar material to expand, travel or stretch in one or more directions.

For the purpose of the present invention, the term "tessellation" or "tessellation pattern" is used interchangeably to describe the method and designs of the disclosed Packaging Structure technology of tiling in the plane of the slits, cuts, perforations, scores, creases and folds of the web section using one or more geometric shapes, called tiles, with no overlaps and no gaps. Such tessellation pattern allows of the web section of corrugate board, plastic or plastic film to expand in three-dimensions when encapsulating and holding one or more objects. The object is held securely in three-dimensions between the web section and the upper surface of the platform portion when the side portions are folded in a direction away from the web section thereby tightening the web section against the object between the web section and the platform portion.

For the purpose of the present invention, the term "Rose Line" refers to a score line or predefined fold line feature that allows a portion of the packaging structure underneath to articulate in such a way as to create a temporary cavity to insert and place an object within the packaging structure to be secured. As is defined for purposes of the present invention, "line of articulation" or "lines of articulation" are fold lines, scores, perforations, removal of material that may be formed as a line to fold, bend, crease or articulate upon. For example, "predefined score line" may be formed by small-cuts, scores, or perforations in the planar structure of the foldable member forming the material of the corrugated board. A "predefined crease line" may be formed by crushing portions of the material forming the planar structure of the foldable member, for example, crushing the material of the corrugated board along a line for folding. Designing fold lines, of course, are chosen depending on the material used to construct the foldable member, appropriateness to the mechanical connection, allowing folding portions to be folded, rotated or to form compound joints permitting one or more side panels to be moved relative to the platform portion from an unfolded position to a folded position. Moreover, according to the concepts of the present invention, predefined scoring pattern on a side panel adjacent the platform portion one or more side panels to be moved relative to the platform portion from an unfolded position to a folded position. Specifically, after joining an attachment portion of the overlap panel to the side panel opposite, the side panels cooperate to tension a web section of the overlap panel by folding the side panels along the fold lines. In this manner, the object is held securely between the web section and the upper surface of the platform portion when the side portions are folded in a direction away from the web portion thereby tightening the web portion against the object between the web section and the platform portion. The line of articulation can be incorporated as a slits or cut outs to secure objects. These concepts and considerations apply to lines of articulation, score, crease or fold lines throughout this description.

Figure 1:
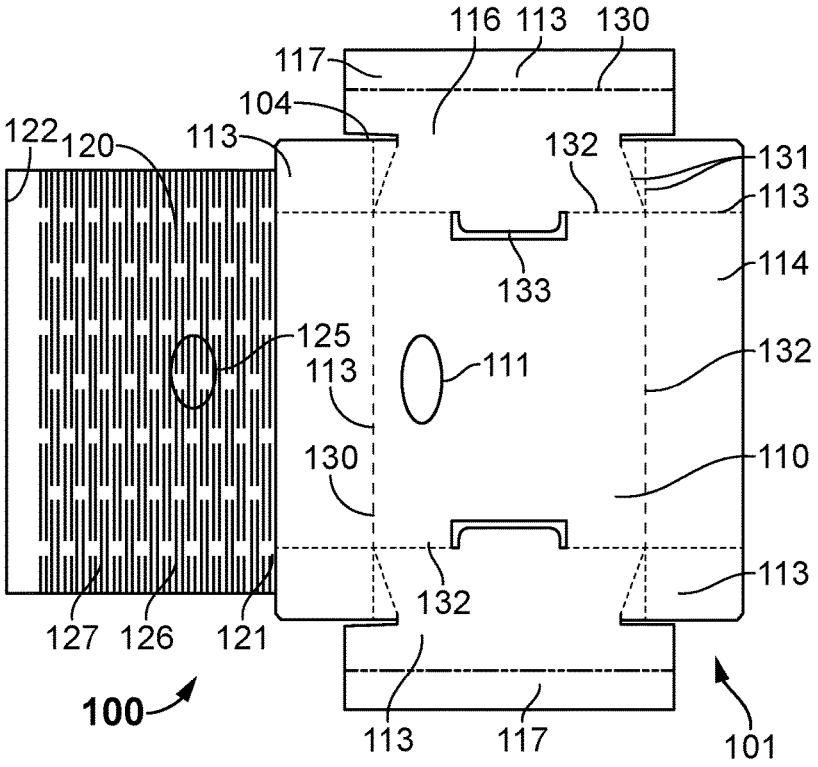
FIG. 1 illustrates an article of packaging as a blank insert that can be manufactured in accordance with a method of manufacturing according to an embodiment of the present invention.
Figure 2:
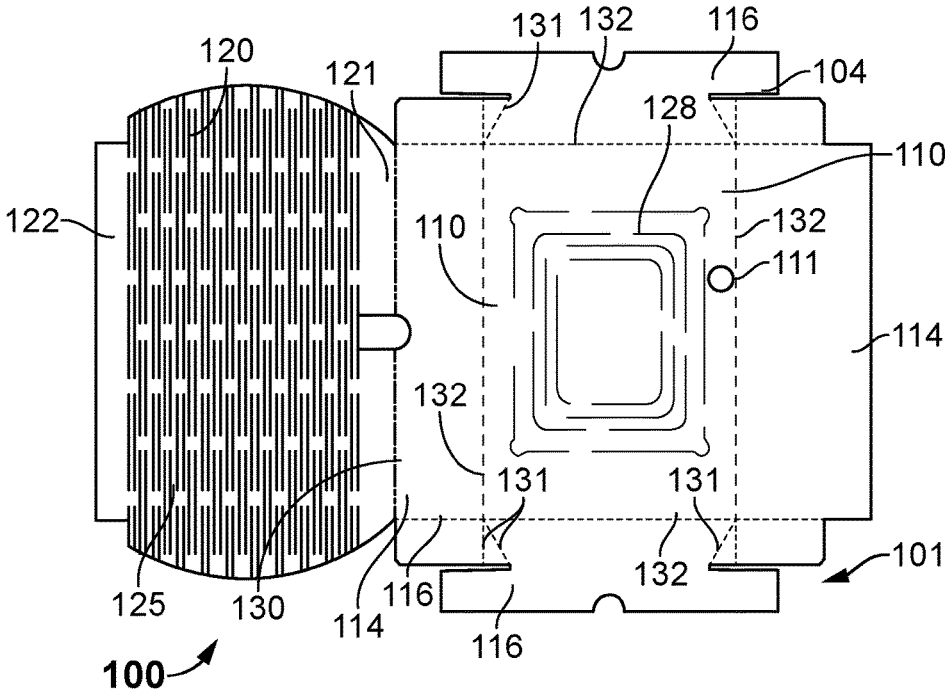
FIG. 2 illustrates an article of packaging featuring a hole, locking feature, web tessellation pattern, and expandable planar surface that inserts into a container.
Figure 3:
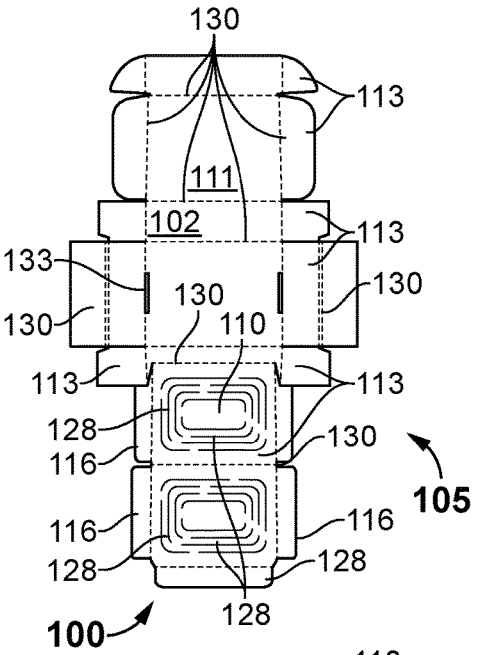
FIG. 3 illustrates an article of packaging for holding an object formed integral to a container.
Figure 4:
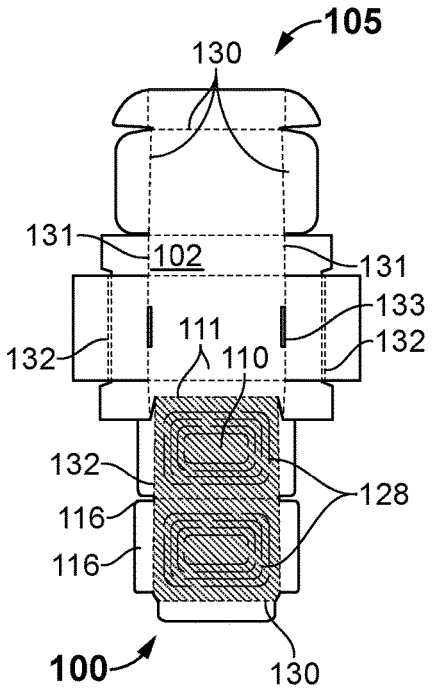
FIG. 4 illustrates an article of packaging for holding an object formed integral to a container with friction coating.
Figure 5:
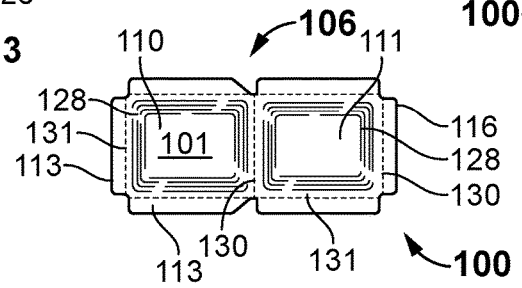
FIG. 5 illustrates an article of packaging for an clam-shell type insert.
Figure 6:
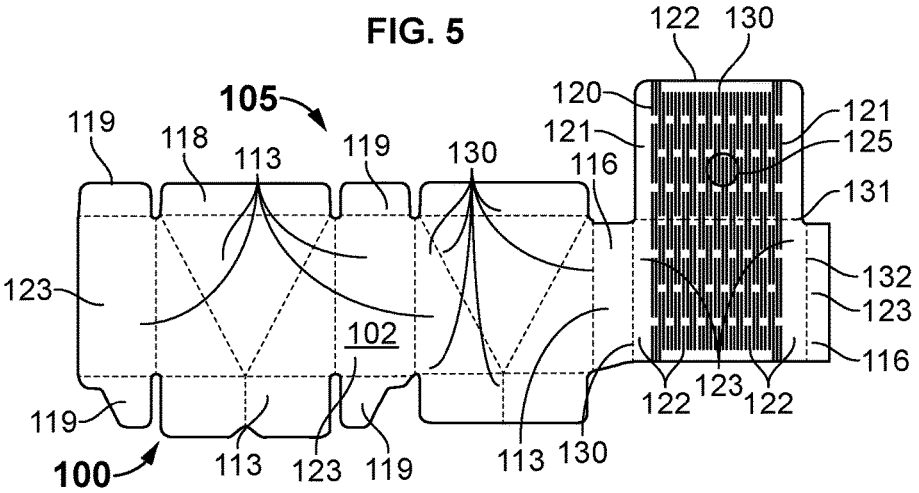
FIG. 6 illustrates an article of packaging in a hammock formed integral to a container.
Figure 7:
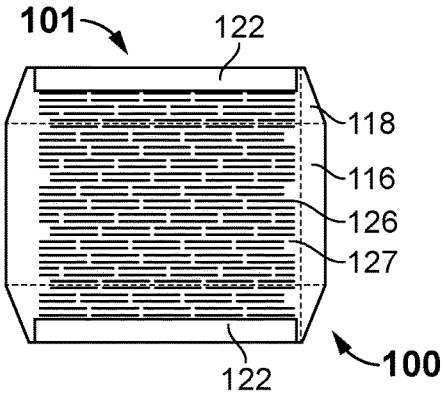
FIG. 7 illustrates an insert article of packaging constructed from separate pieces of web and semi rigid material.
Figure 8:
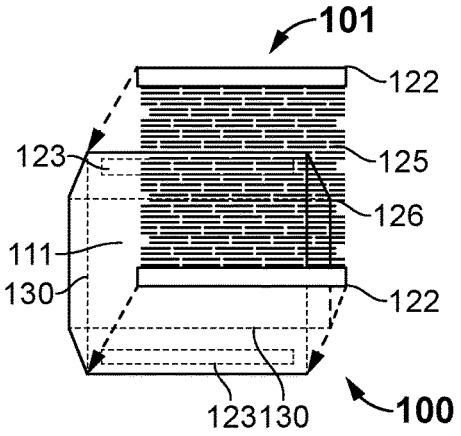
FIG. 8 illustrates forming the insert article of packaging of FIG. 7.
Figure 9:
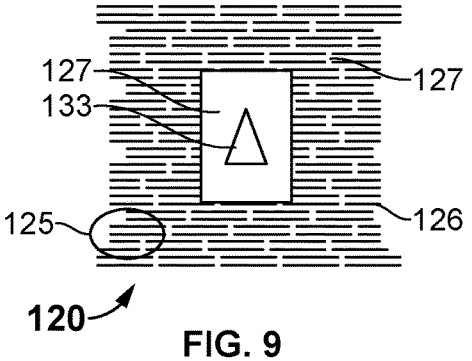
FIG. 9 illustrates an predefined tessellation pattern in the web pattern for holding a triangular object.
Figure 10:
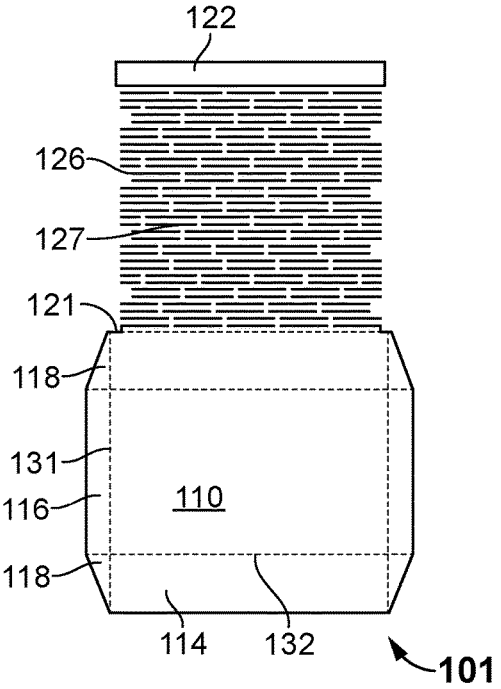
FIG. 10 illustrates an overlap insert article of packaging.
Figure 11:
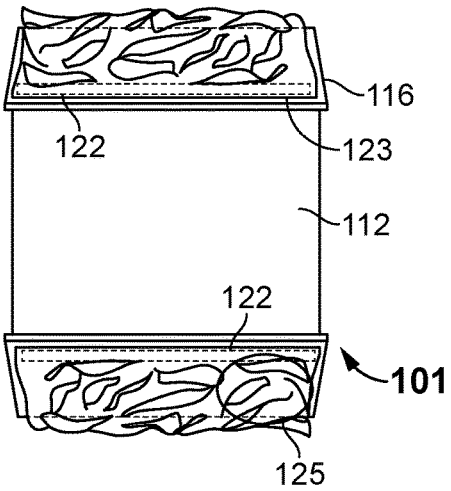
FIG. 11 illustrates a bottom view folding flaps downwardly to apply tension to the insert article of packaging.
Figure 12A:
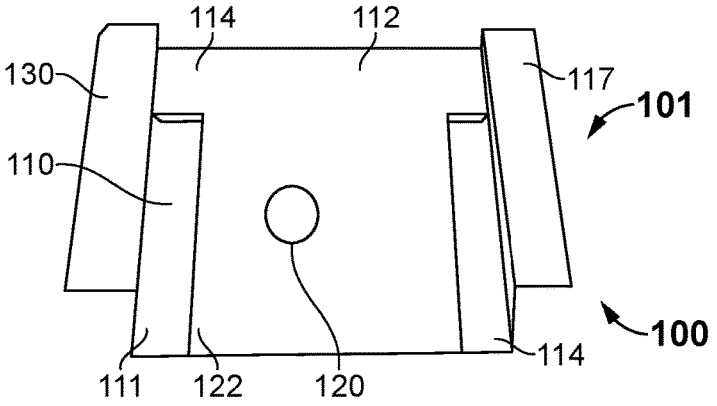
FIGS. 12A, 12B, 12C illustrate the operation of the packaging article of the present invention.
Figure 12B:
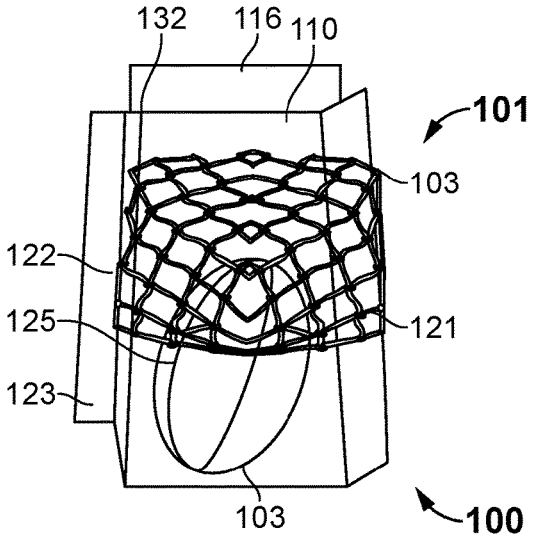
Figure 12C:
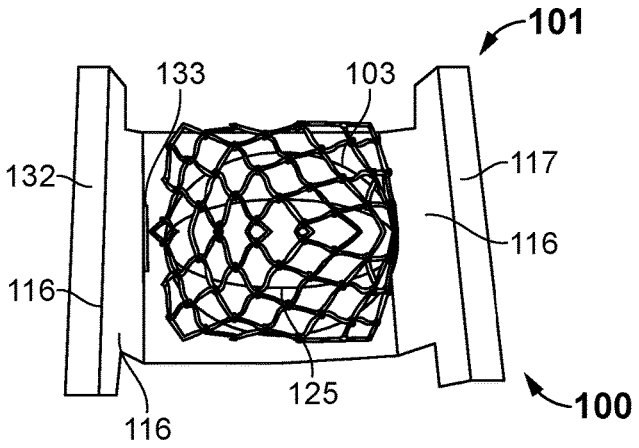

Referring to FIGS. 1 and 2, the article of packaging 100 according to the present invention is described. The article 100 can be an insert 101 or a container 102 for holding an object 102 as shown in FIGS. 12A, 12B, and 12C. The article has a generally planar structure and can be made from corrugated fiberboard, corrugated plastic as well as other materials such as any semi rigid planar material where features and methods of use of the technology "packaging structure" can be utilized. This includes solid and semi solid, semi-rigid planar materials or combinations of such materials. In FIGS. 1-6 and 10, for example, the article 100 a contiguous piece of material or, as is shown in FIGS. 7-9, and other figures, the combination of two non-contiguous materials joined at some attachment point or method, this technology can be made of one or more component materials all of which constituting the overall disclosure.

Generally the article has a predefined pattern 104, whether a box or an insert with slots and lines of articulation. The insert 101 of FIGS. 1 and 2 is configured with a platform 110, an upper surface 111, which supports and retains the object 103, a lower surface 112 (underside). The article 100 has a predefined pattern with one or more panels 113 formed by slotting according to a predefined slot pattern, one or more side retention flap(s) 114 that are used to elevate the object in the container and to tension the web 120, one or more end bracing flap(s) 116 that space the end of the platform from the wall of the container 102, one or more end spacing flaps 117 used to create additional voids, spacing and the like of the platform 110 from the wall of the container 102, connecting corner flaps 118, and interlocking bracing 119 such as tabs, holes to lock a flap 113 in a predefined position.

FIGS. 1 and 2 also show the web section 120 that is configured in a predefined pattern, which can advantageously be a tessellation pattern to secure the object 103 in multiple directions, for example, three dimensions using corrugate board, plastic or common films without reliance upon elastomeric film-blends. The web advantageously can be an expanding "hexpand" web formed from slits 126 and nodes 127 in a predefined pattern 125, such as, for example, as is illustrated in Examples 1, 2 and 3 herein. The slits can be punch outs, or omissions of materials. The nodes can be solid materials. As is illustrated in FIG. 9, the web 120 can have a predefined web pattern 125 including a large node in the hexpand pattern and a cut out for the object 103, such as a three dimensional pyramid such that the object can be held securely according the present invention. The types of predefined patterns 125 are potentially unlimited utilizing tessellation functions and patterns.

Figure 26:
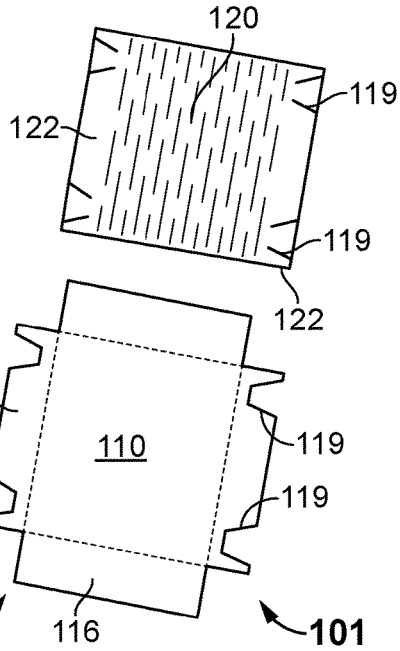
FIG. 26 illustrates an interlocking tab attachment for a packaging insert of the present invention.
Figure 27:
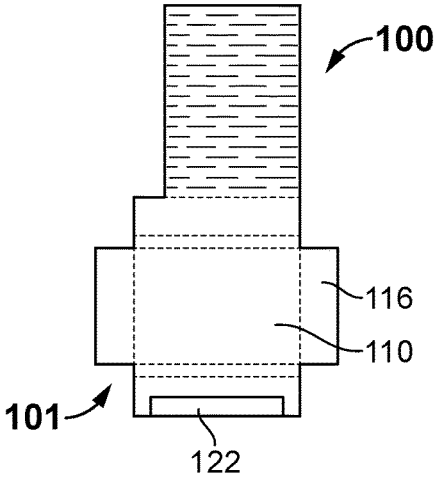
FIG. 27 illustrates insert packaging with an offset web pattern of the present invention.
Figure 29:
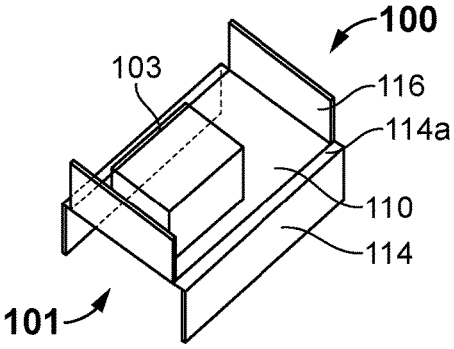
FIG. 29 illustrates placement of the object for the offset insert packaging design.
Figure 28:
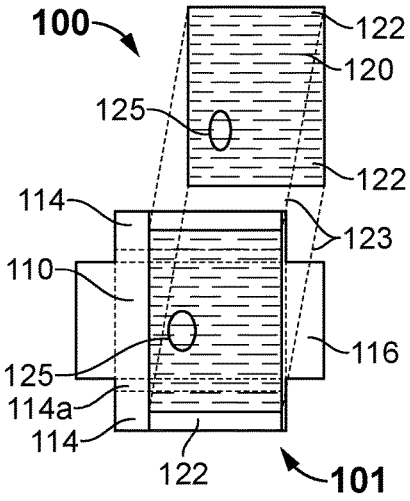
FIG. 28 illustrates offset insert packaging design of the present invention.
Figure 30:
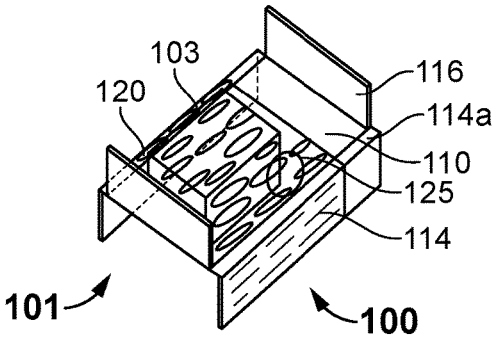
FIG. 30 illustrates folded side and end flaps of the offset insert packaging design of the present invention.
Figure 31:
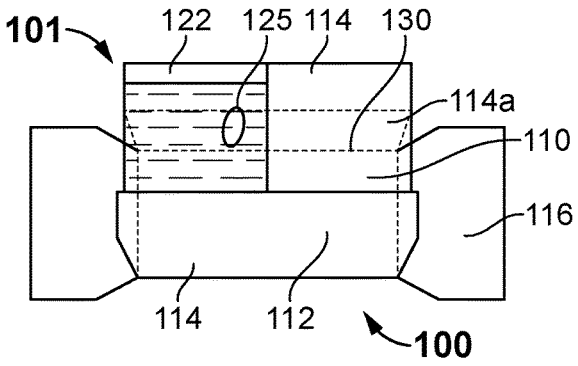
FIG. 31 illustrates a packaging insert of the present invention.
Figure 32:
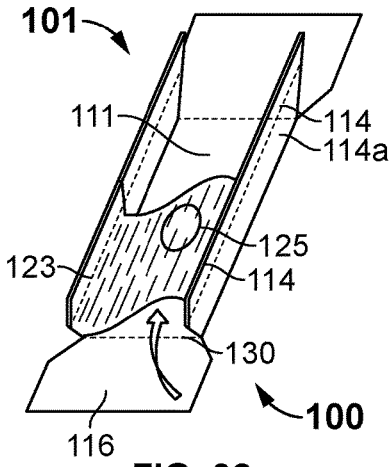
FIG. 32 illustrates a folded packaging insert of FIG. 31.
Figure 33:
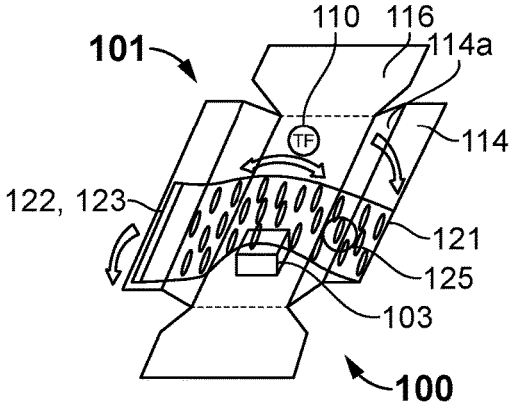
FIG. 33 illustrates the packaging insert of FIGS. 31 and 32.
Figure 34:
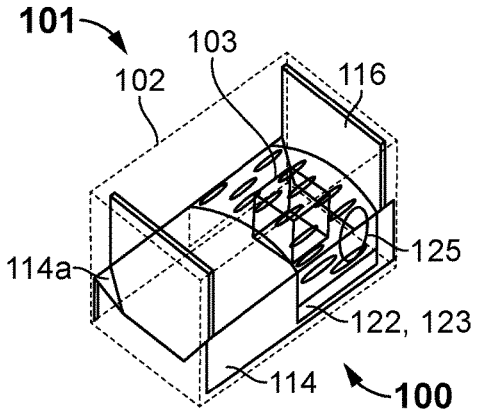
FIG. 34 illustrates the packaging insert of FIGS. 31, 32 and 33.
Figure 35:
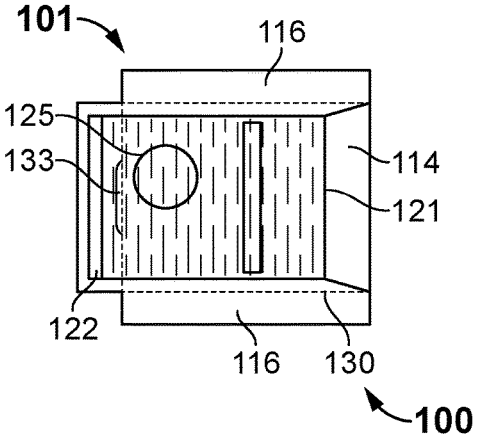
FIG. 35 illustrates a packaging insert of the present invention.
Figure 36:
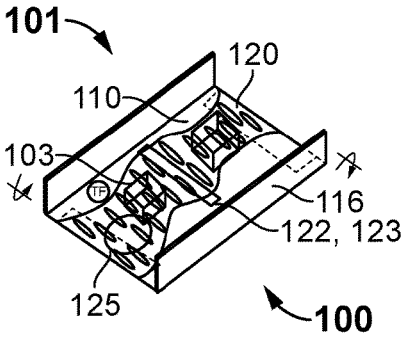
FIG. 36 illustrates the folded packaging insert of FIG. 35.
Figure 37:
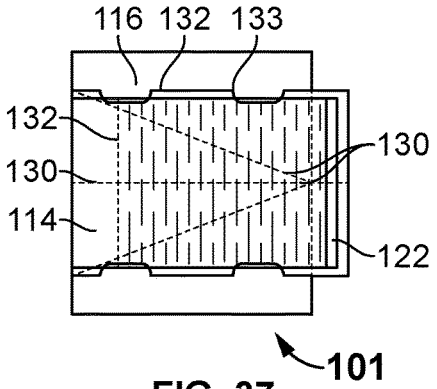
FIG. 37 illustrates a packaging insert of the present invention.
Figure 38:
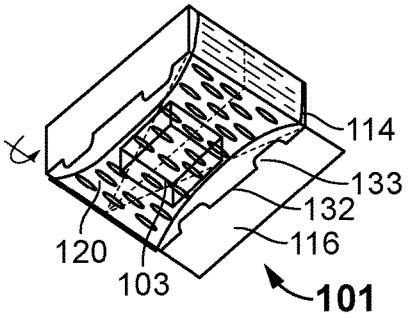
FIG. 38 illustrates the folded packaging insert of FIG. 37.
Figure 39:
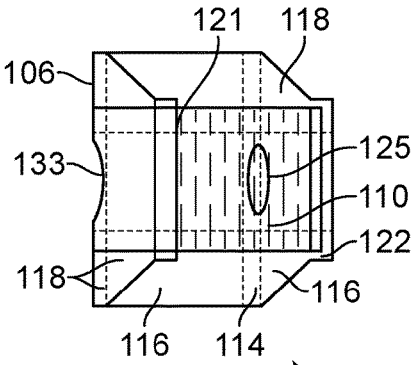
FIG. 39 illustrates a packaging insert of the present invention.
Figure 40:
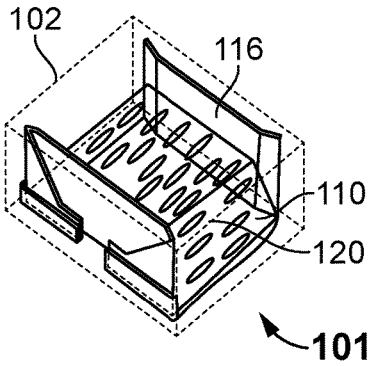
FIG. 40 illustrates the packaging insert of FIG. 39.
Figure 41:
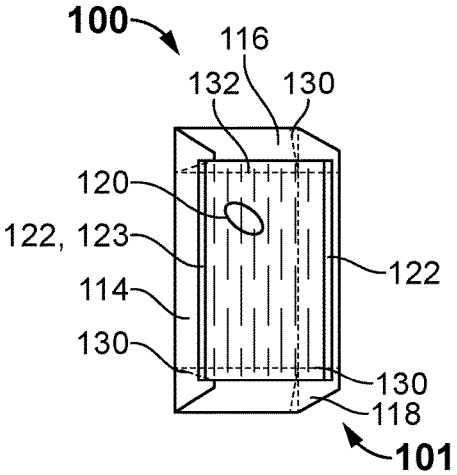
FIG. 41 illustrates a packaging insert of the present invention.
Figure 42:
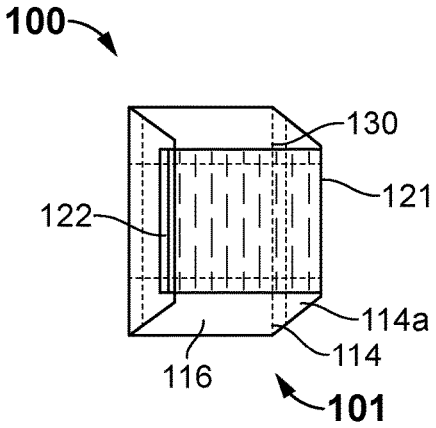
FIG. 42 illustrates a packaging insert of the present invention.
Figure 43:
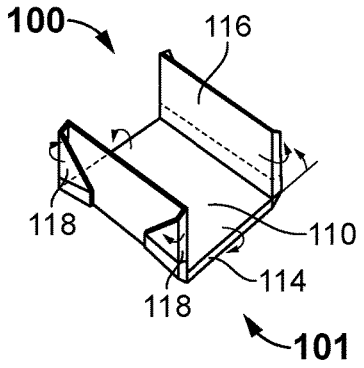
FIG. 43 illustrates the folded packaging inserts of FIGS. 41 and 42.
Figure 44:
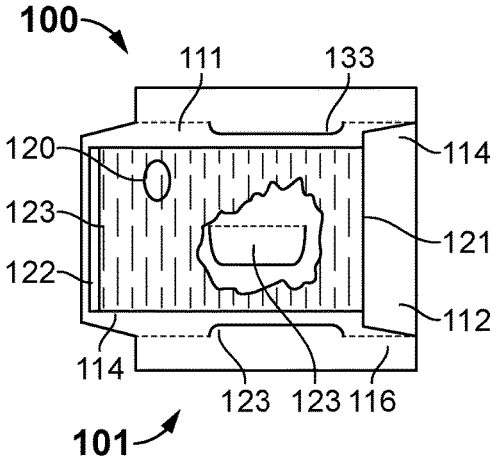
FIG. 44 illustrates a packaging insert of the present invention.
Figure 45:
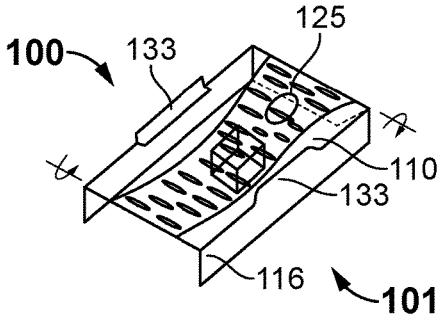
FIG. 45 illustrates the folded packaging insert of FIG. 45.
Figure 46:
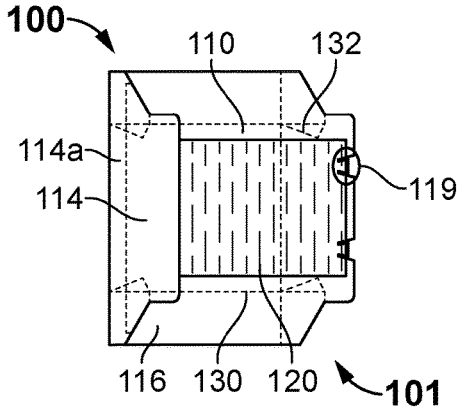
FIG. 46 illustrates a packaging insert of the present invention.
Figure 47:
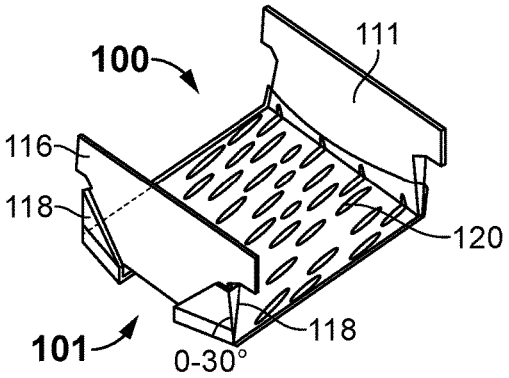
FIG. 47 illustrates the folded packaging insert of FIG. 46.
Figure 48:
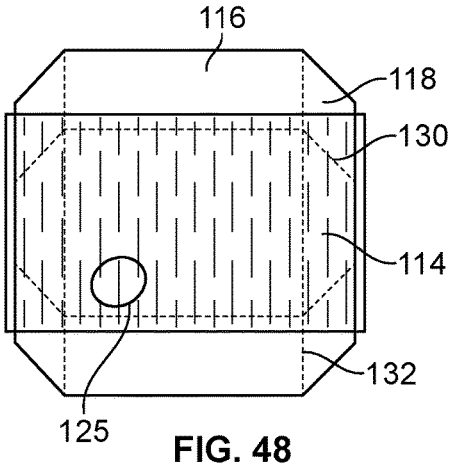
FIG. 48 illustrates a packaging insert of the present invention.
Figure 49:
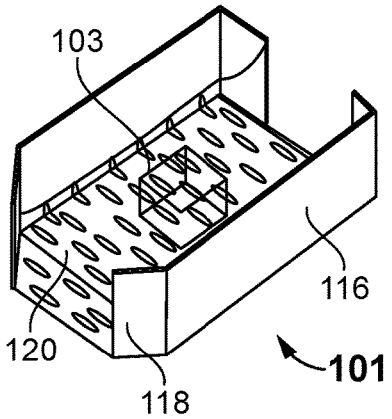
FIG. 49 illustrates the folded packaging insert of FIG. 48.
Figure 50:
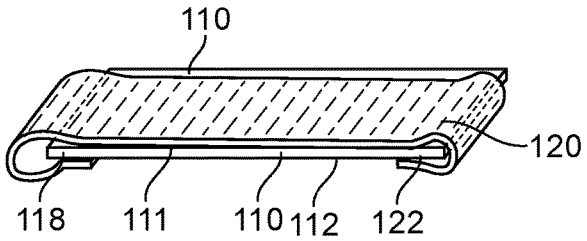
FIG. 50 illustrates a side view of the folded packaging insert of FIGS. 48 and 49.
Figure 51:
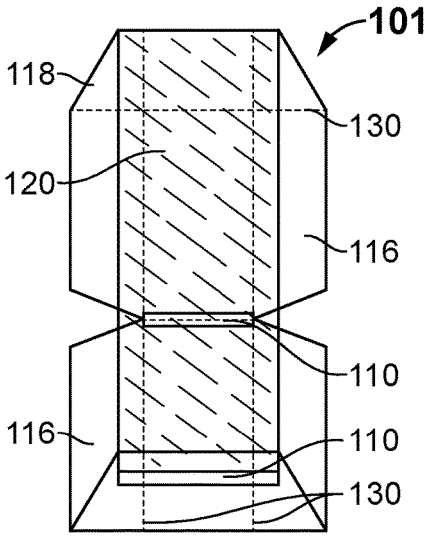
FIG. 51 illustrates a packaging insert of the present invention.
Figure 52:
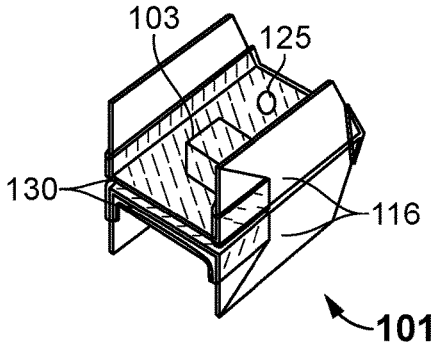
FIG. 52 illustrates the folded packaging insert of FIG. 51.
Figure 53:
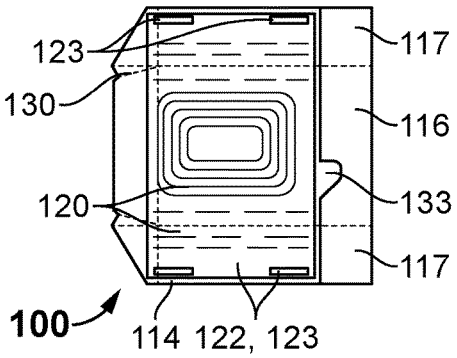
FIG. 53 illustrates a packaging insert of the present invention.
Figure 54:
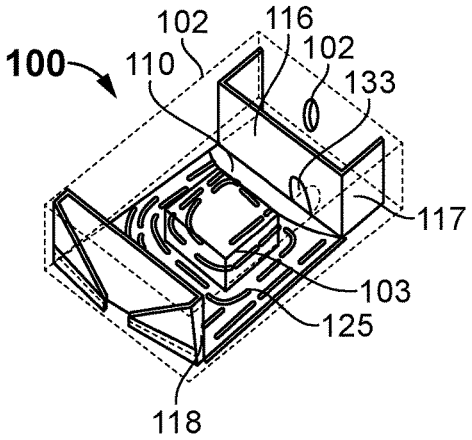
FIG. 54 illustrates the folded packaging insert of FIG. 53.
Figure 55:
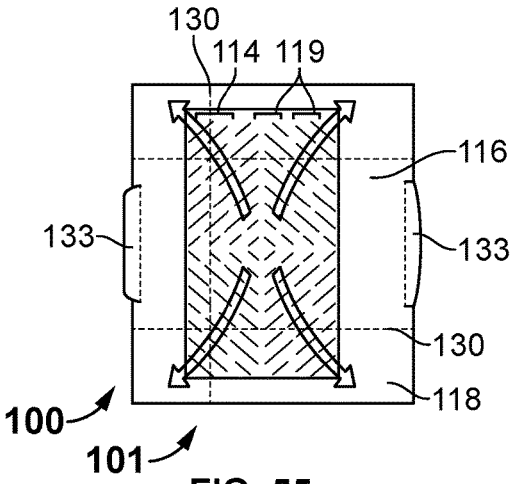
FIG. 55 illustrates a packaging insert of the present invention.
Figure 56:
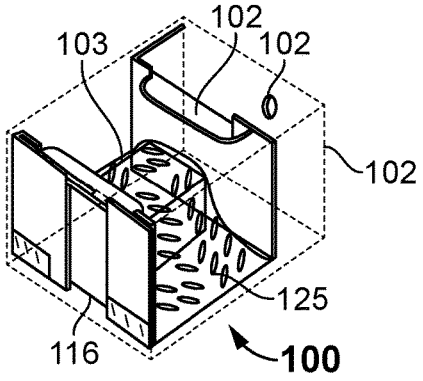
FIG. 56 illustrates the folded packaging insert of FIG. 55.
Figure 57:
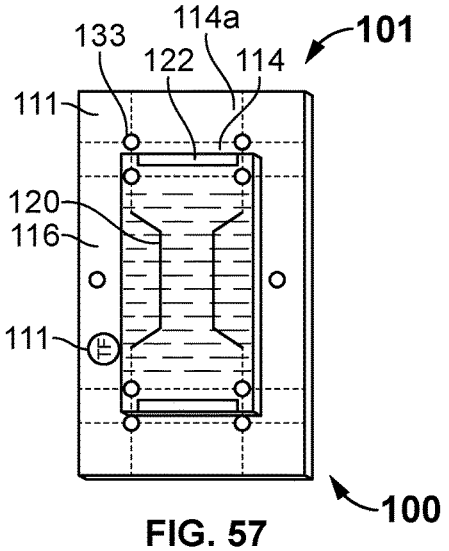
FIG. 57 illustrates a packaging insert of the present invention.
Figure 58:
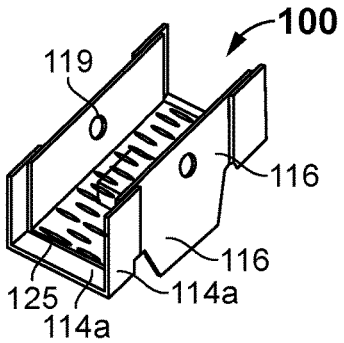
FIG. 58 illustrates the folded packaging insert of FIG. 58.
Figure 59:
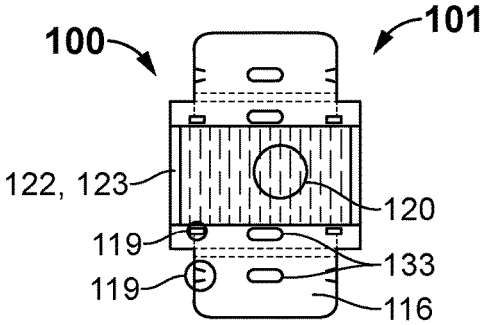
FIG. 59 illustrates a packaging insert of the present invention.
Figure 60:
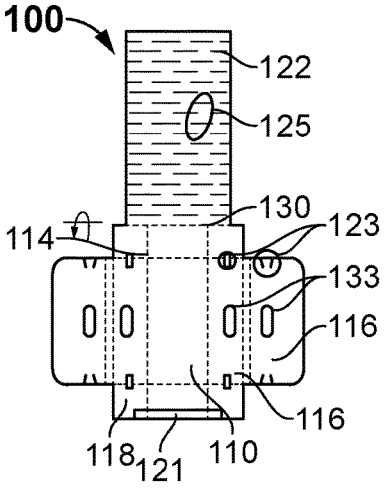
FIG. 60 illustrates a packaging insert of the present invention.
Figure 61:
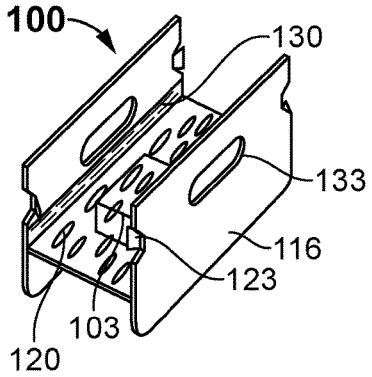
FIG. 61 illustrates the folded packaging insert of FIG. 61.
Figure 62:
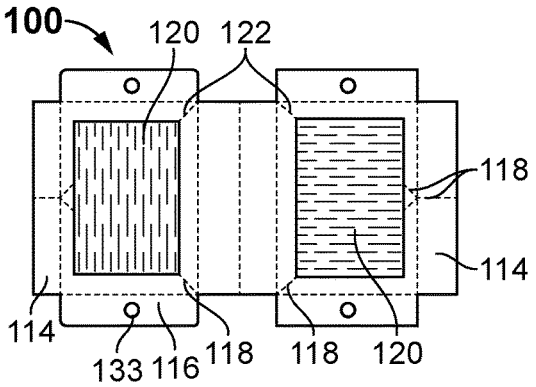
FIG. 62 illustrates a packaging insert of the present invention.
Figure 63:
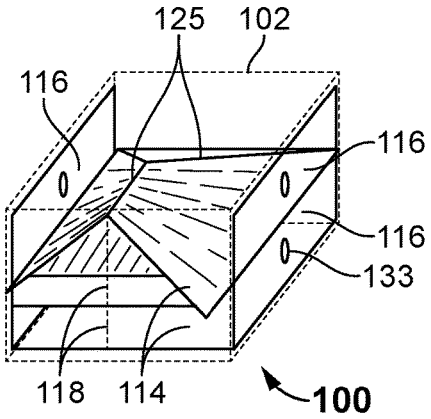
FIG. 63 illustrates the folded packaging insert of FIG. 63.
Figure 64:
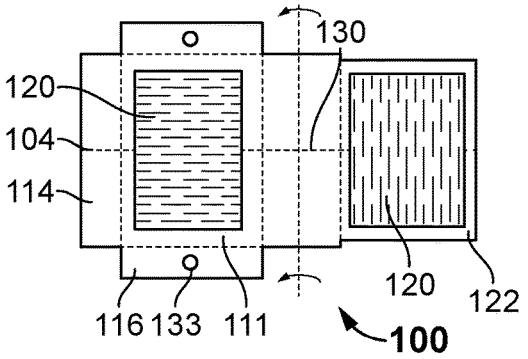
FIG. 64 illustrates a packaging insert of the present invention.
Figure 65:
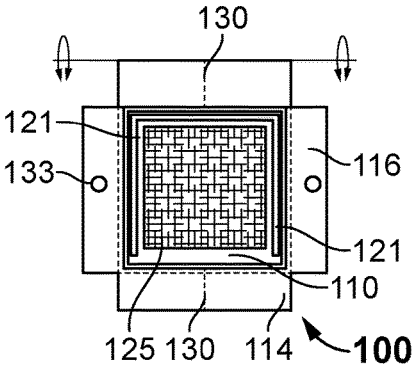
FIG. 65 illustrates the folded packaging insert of FIG. 64.
Figure 66:
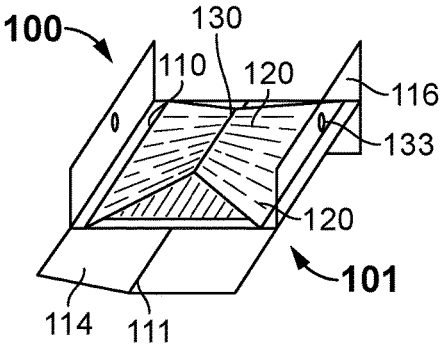
FIG. 66 illustrates front view of the folded packaging insert of FIG. 65.
Figure 67:
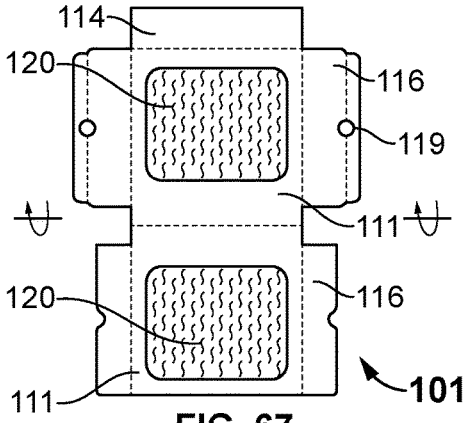
FIG. 67 illustrates a packaging insert of the present invention.
Figure 68:
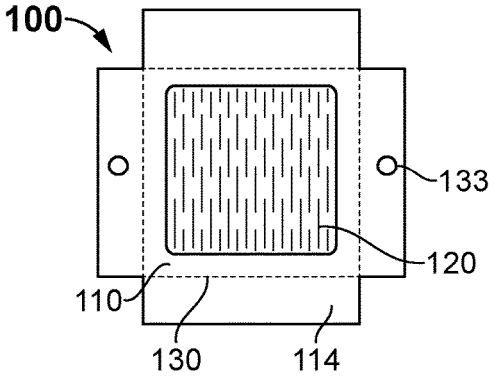
FIG. 68 illustrates the folded packaging insert of FIG. 67.
Figure 69:
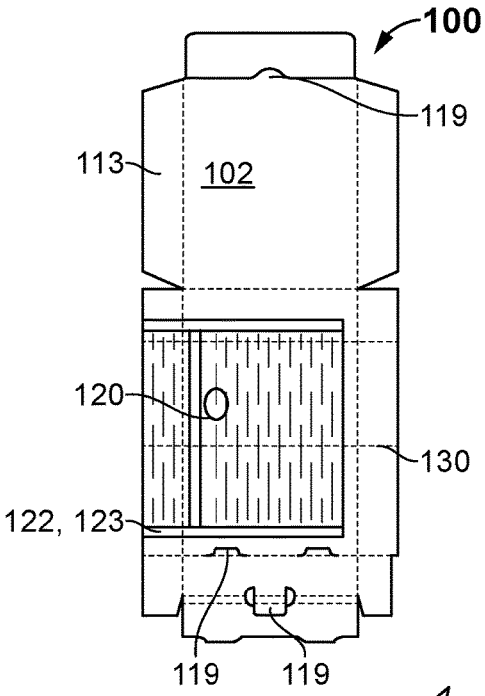
FIG. 69 illustrates a packaging box of the present invention.
Figure 70:
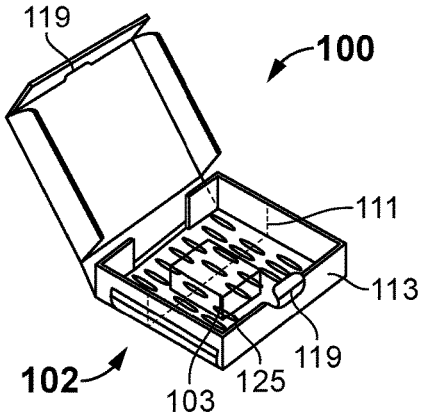
FIG. 70 illustrates the folded packaging box of FIG. 69.
Figure 71:
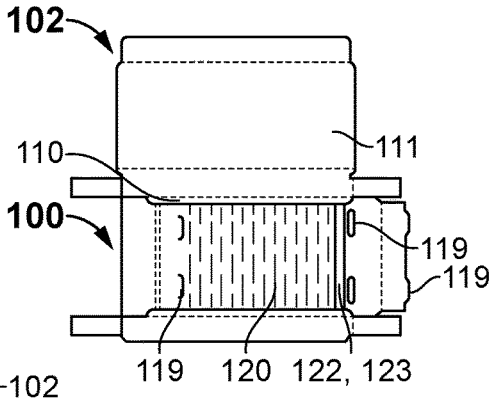
FIG. 71 illustrates a packaging box of the present invention.
Figure 72:
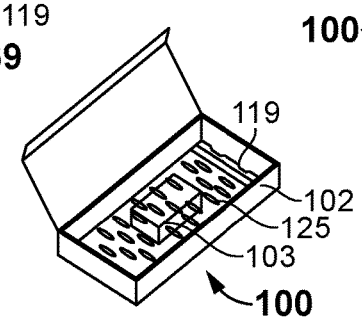
FIG. 72 illustrates the folded packaging box of FIG. 71.
Figure 73:
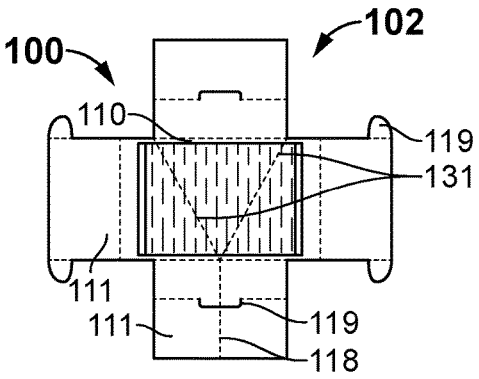
FIG. 73 illustrates a packaging box of the present invention.
Figure 74:
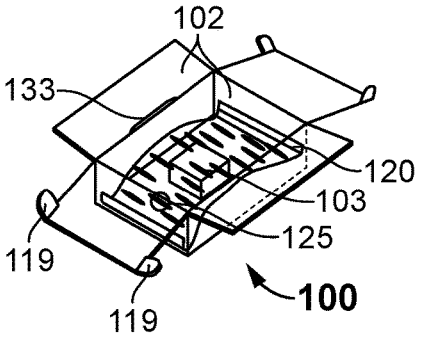
FIG. 74 illustrates the folded packaging box of FIG. 73.
Figure 75:
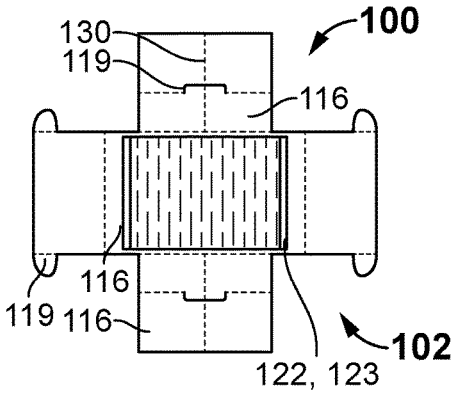
FIG. 75 illustrates a packaging box of the present invention.
Figure 76:
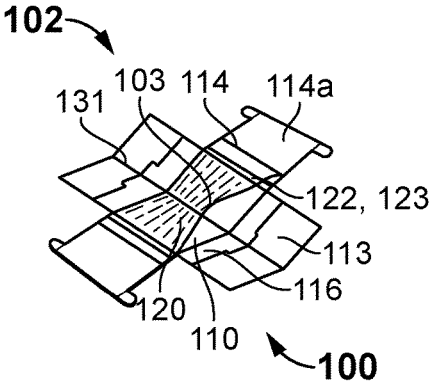
FIG. 76 illustrates the folded packaging box of FIG. 75.
Figure 77:
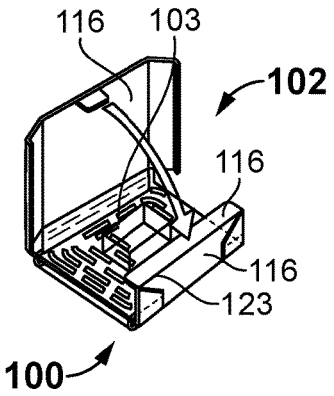
FIG. 77 illustrates a packaging box of the present invention.

The web 120 also includes a support frame 121 which can be used when affixing or securing, for example, by adhesives to the side retention flap 114 or other panel 113. An attachment portion 122, as is shown in FIG. 26, can include interlocking tabs to secure the web 120 to the semi rigid planar member. Also a predefined extensible pattern 128 can be formed in the platform 110 such that when the flaps 114 place tension on the web 120, the object can expand into the platform 110 so as to be secured therein. The predefined extensible pattern 128 can be formed in the flap 114, for example, replacing the web 120 with an extended flap 114 with the predefined extensible pattern 128 formed therein such as in FIGS. 3-5. The upper surface 111 of planar structure of the semi rigid member, e.g. the platform 110 and web 120 and extensible pattern 128, can be coated with a high friction coating to further secure and prevent unwanted movement of the object 103 in the article.

The pattern of lines of articulation 130 can be designed in patterns to create folds, compound joints and other features using creases 131, scores 132, perforations, cut outs 133, whenever a flap or panel 113 is needed to articulate on two planes. A predetermined pattern of lines of articulation 130 allow for a multitude of designs for the article 100 of the present invention.

According to the present invention, insert packaging 101, made from either a single contiguous planar member or from sub-parts, can be formed according to the present invention, as is illustrated in FIGS. 1, 2, 5, 12A-12C, 18A-18E, 14-20, and 23-68. The present invention used a contiguous predefined pattern 104 of an insert shape 104 comprising a platform portion 110, one or more side panel (s) 113, including specific flap features 114-119, and a web section 120 overlap panel of flap 114 having a predefined tessellation pattern which can be hexpand or other tessellation pattern. The web section 120 overlap panel is formed in said planar surface and attached 123 having an attachment portion 122 so as to fold over the upper surface 110 of said platform portion 110 and to join 123 at the attachment portion 122 or directly to the web portion 120 to a side panel 114 opposite by folding said overlap portion or directly to the upper or lower surfaces 111, 112 of the platform 110. In this manner the object 103 is held securely between the web section 120 and the upper surface 111 of the platform portion 110 when the side portions 113, for example flaps 114, are folded in a direction away from the web section 120 thereby tightening the web section 120 against the object 103 between the web section 120 and the platform portion 110.

Similarly, boxes and container packaging 102 made from either a single contiguous planar member in a predefined pattern 104 of a box shape 105 can be formed according to the present invention as is shown in FIGS. 3, 4, 6 and 71-78. Again, the combination of the and a web section 120 overlap panel of flap 114 having a predefined tessellation pattern is a significant improvement over the art and provides advantages in the manufacture and cost of the article. The extensible pattern 130 is also an improvement of the present invention FIGS. 12A, 12B, and 12C, illustrate the operation of the present invention for insert and container packaging articles to retain an object between the platform and the web section by articulate relative to the plain of the platform. In this description the object is held securely between the web section and the upper surface of the platform portion when the side portions are folded in a direction away from the web section thereby tightening the web section against the object between the web section and the platform portion. Referring to FIG. 12A, first the insert packaging article is placed on a flat surface. As shown in FIG. 12B, the object is inserted beneath the web, film membrane or otherwise between the upper platform surface and the web section. It is advantageous to center the object on the platform surface as this will orient the object in the center of the container away from the side walls. As shown in FIG. 12 C, the side retention flaps are grasped and simultaneously folded beneath the platform. The end bracing flaps are folding upwardly creating end walls that are disposed adjacent a side wall of a container. The end bracing flaps can have locking structures such as, for examples, an opening aligning and cooperating with a tab that locks the end wall in place pushing the tab into the opening in the end bracing flap. In this manner the user can use a thumb or finger to push the locking tab through the opening to lock in place on each side of the end walls. The insert packaging article is now ready to be loaded into the container. If the insert packaging article has end spacing flaps, these flaps are designed to maintain spacing adjacent from a side wall of a container and provide an additional bracing flap. With the insert packaging article loaded into the container, the spacing flaps are positioned and unfolded to lock in a corner or otherwise provide additional spacing from the end wall.

Figure 13A:
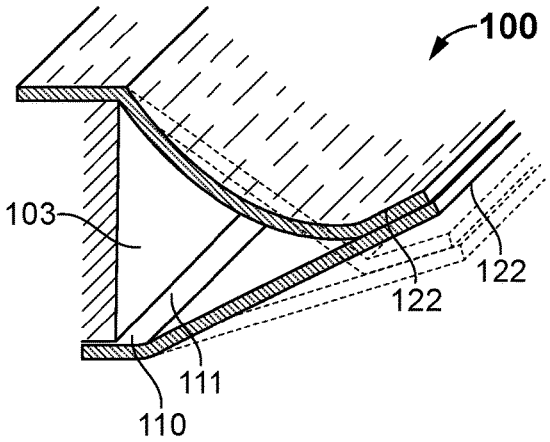
FIGS. 13A, 13B, 13C, and 13D illustrate attachment and tension action of the side retention flaps of the present invention; [none yet]
Figure 13B:
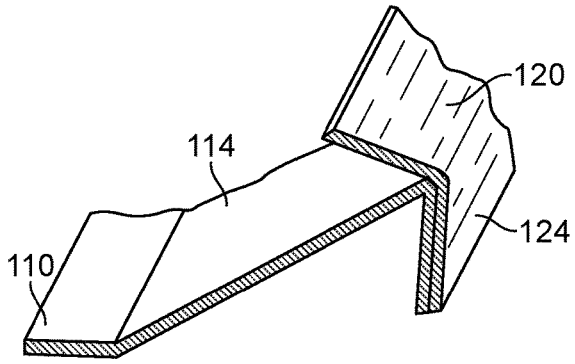
Figure 13C:
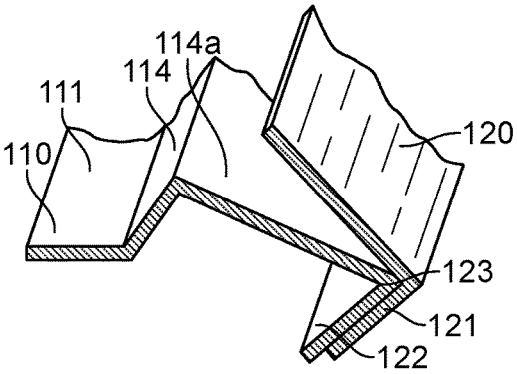
Figure 13D:
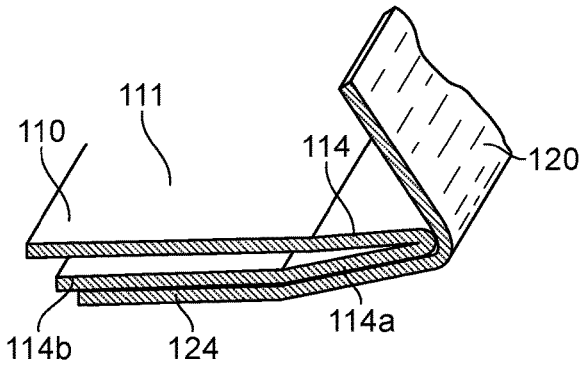
Figure 14:
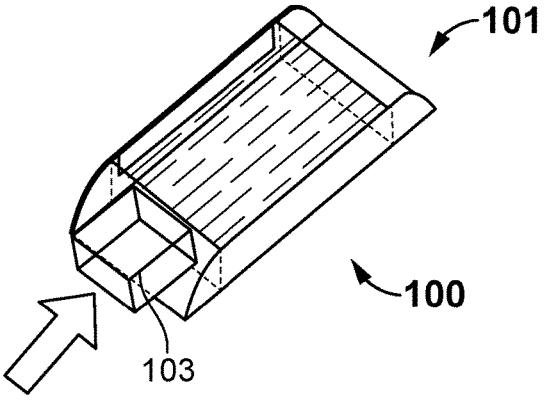
FIG. 14 illustrates inserting the object into the packaging article of the present invention.
Figure 15:
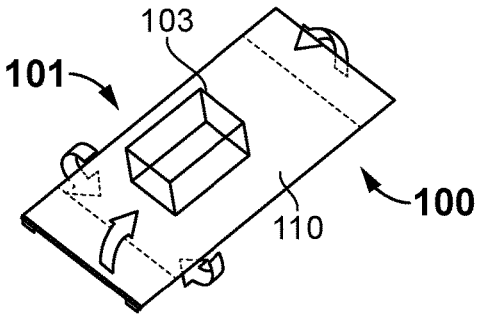
FIG. 15 illustrates the object centered on the semi rigid member planar surface.
Figure 16:
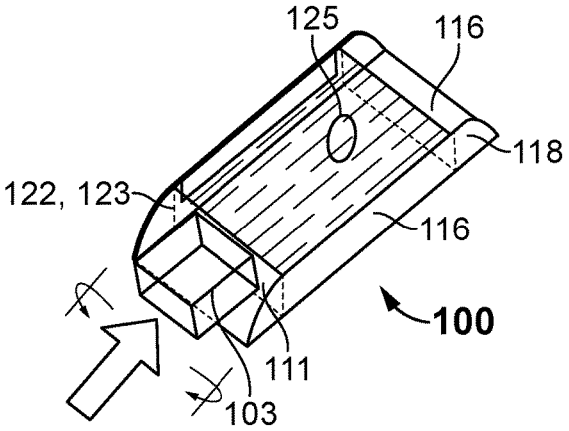
FIG. 16 illustrates inserting the object and folding of side panels.
Figure 17:
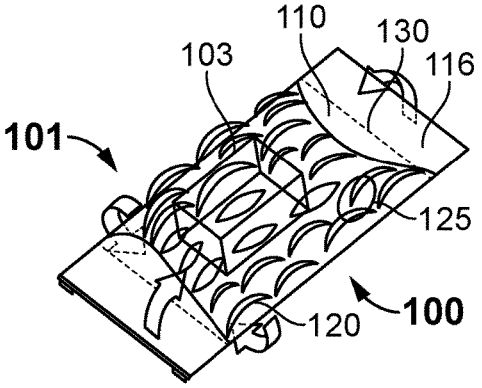
FIG. 17 illustrates web tension on the object with side panels folded.
Figure 18A:
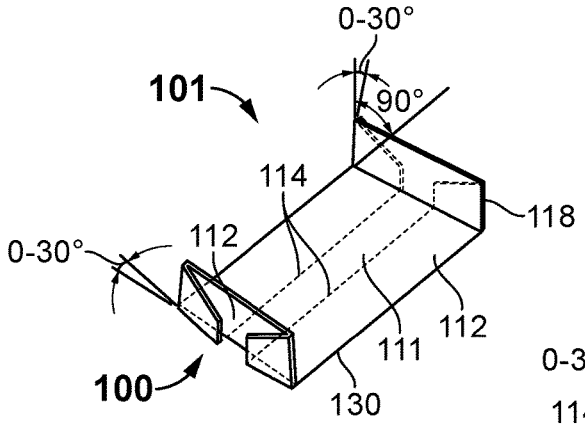
FIGS. 18A, 18B, 18C, 18D, and 18E illustrate an upward bracing side flap insert packaging embodiment of the present invention.
Figure 18B:
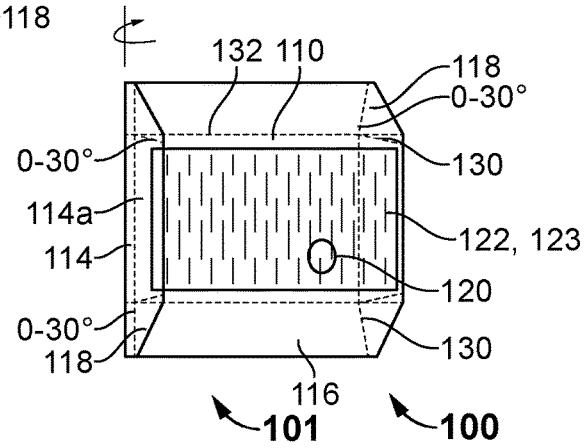
Figure 18C:
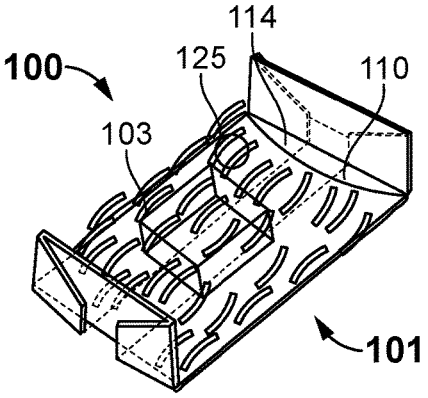
Figure 18D:
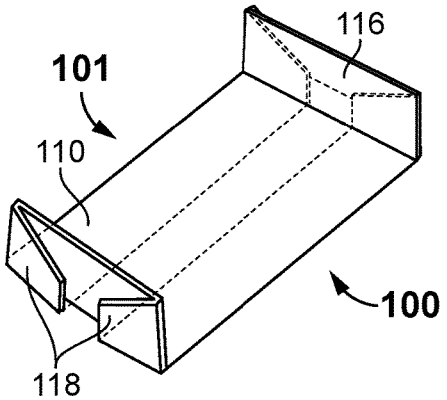
Figure 18E:
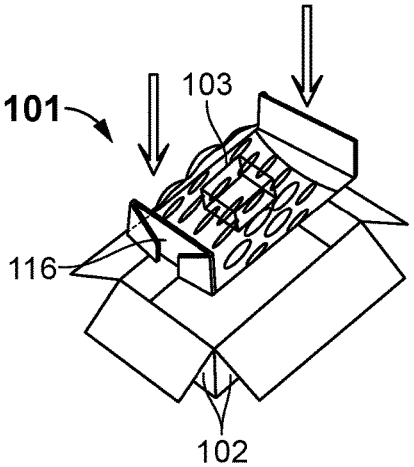
Figure 19:
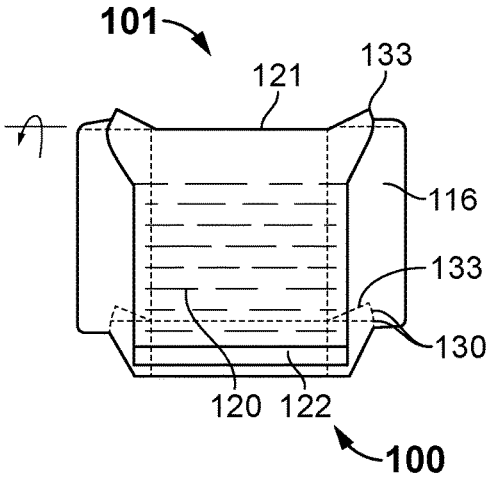
FIG. 19 illustrates end spacing flaps of an upward bracing insert packaging embodiment of the present invention.
Figure 20:
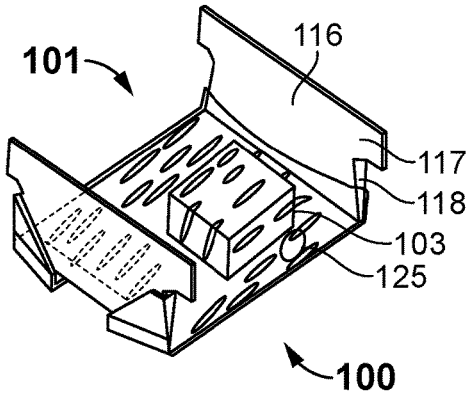
FIG. 20 illustrates a folded insert packaging of FIG. 19 according to the present invention.
Figure 21:
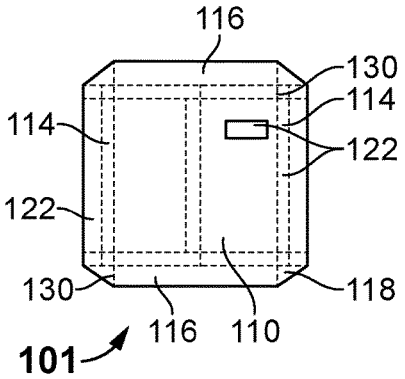
FIG. 21 illustrates an example affixing points for the web section of a packaging insert.
Figure 22:
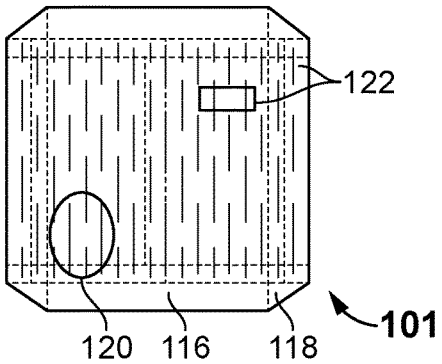
FIG. 22 illustrates a web section affixed at multiple points forming a packaging insert of the present invention.
Figure 23:
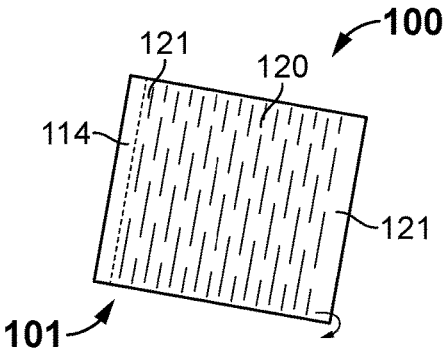
FIG. 23 illustrates affixing an attachment portion to the platform.
Figure 24:
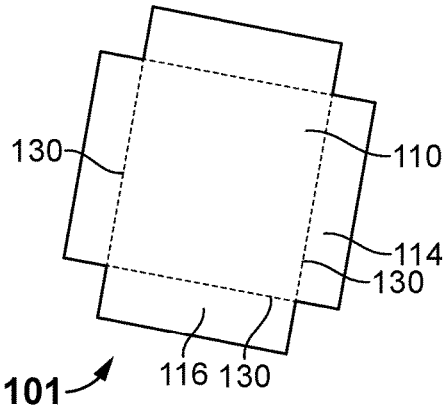
FIG. 24 illustrates the platform being attached to the web attachment portion of FIG. 23.
Figure 25:
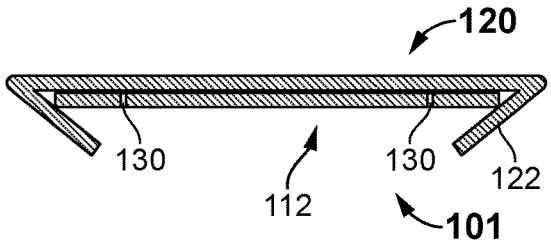
FIG. 25 illustrates a web attaching to the lower surface of the platform.

FIGS. 13A, 13B, 13C and 13D, illustrate the attachment portion of the present invention. The attachment can be from a web support frame 121, an attachment portion 122 adjacent to the overlap of the web 120, and or a separate attachment structure 123 such as holes or interlocking tabs. FIG. 13A is a side perspective view of the side retention flap 114 demonstrating an attachment point of the web 120. The attachment may be adhesives, tabs, staples, and the like. The object 102 appears as placed under the web 120 and above the platform 110. The web 120 is in a non-expanded static state. FIGS. 13B, 13C and 13D illustrate two panel side retention flaps 114 and 114*a*. The attachment point 122 is located on side retention panel 114*a* with the web 120 that is not taunt or expanded. The benefit of such is to gain a greater leverage to expand and taunt the web 120 when articulating the side retention flaps 114, 114*a* and 114*b* underneath the platform 110. FIG. 13D shows retention flaps 114, 114*a* and 114*b* are fully assembled and articulated underneath the platform 110.

Example: 1

A predefined tessellation pattern of said web portion has HEXPAND two-node format, as follows:

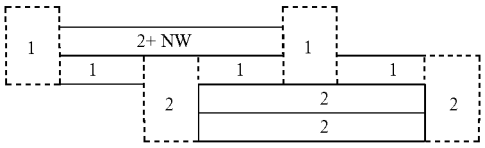

Where the cross leg length C=2.75" inches; the leg thickness D=0.25"; the node length NL=0.75" and the node width NL=0.50", and repeats by arranging Node 1 and Node 2 in a staggered offset.

Example 2

A predefined tessellation pattern of said web portion has HEXPAND three-node format, as follows:

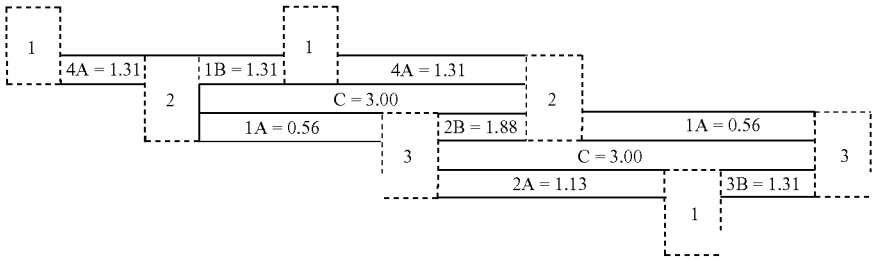

Where the cross leg length C=3.0" inches; the leg thickness D=0.25"; the node length NL=0.75" and the node width NL=0.50", and repeats by arranging Node 1, Node 2 and Node 3 are in a staggered offset.

Example 3

A predefined tessellation pattern of said web portion has HEXPAND four-node format, as follows:

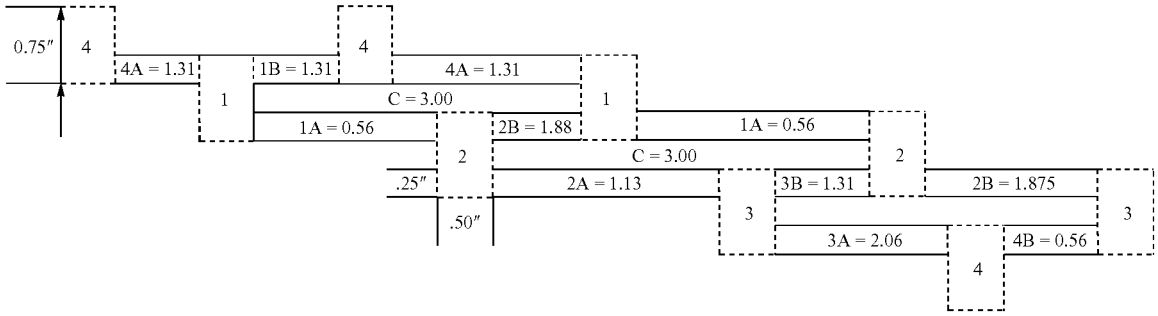

Where the cross leg length C=3.0" inches; the leg thickness D=0.25"; the node length NL=0.75" and the node width NL=0.50", and repeats by arranging Node 1, Node 2, Node 3 and Node 4 are in a staggered offset.

The packaging article 100 can be manufactured by die-cutting or other methods of manufacturing corrugate board inserts and boxes to form either an insert 101 or container 102. The method of manufacturing comprising the steps of cutting semi rigid planar material to an outline of the box or container, herein a "predefined insert" shape to adapted to be received into a container or "predefine container" pattern. Manufacturing by die-cutting can cut, slot and form lines of articulation in the semi rigid planar material during the stamping process. A predefined slot design provides flaps to retain the object at an intermediate position within said container. The die can create predefined lines of articulation in the semi rigid planar material to provide control bending of said semi rigid material. And the die can cut a predefined web pattern, herein a tessellation pattern or Hexpand into the predefined insert shape, the platform or in the overlap portion of the container containing the predefined web pattern. Slits and or removing material create the predefined tessellation pattern on at least one surface of corrugate board. In another step, adhesives or other securing of the attachment portion 122 to the side retention flap 114 for example can be performed. The previous step of forming a predefined line of articulation to arrange said predefined web pattern allows the overlap to be folded over, which can be scoring, slotting, flattening, perforating and cutting steps and can be accomplished substantially simultaneously. In the manufacturing process, the web 120 can be flattened by the pressed and die-cutting, which advantageously provides release to the predefined web pattern for expansion. The predefined lines of articulation can be made by die-cutting as well as also offset cam rolling, continuous and or progressive stamping.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An article of packaging for holding an object securely, the packaging article comprising:

a foldable member, comprising:

a planar structure having an upper surface and a lower surface, a contiguous predefined pattern comprising:

a platform portion, one or more side panels contiguous to said platform portion, said one or more side panels having lines of articulation adapted to fold said one or more side panels to form sides of a platform of the article for packaging, and a web section in a predefined tessellation pattern, said web section adapted to fold a line of articulation between said web section and said platform portion to secure the object placed between said web section and said platform portion, said web section having an attachment portion adapted to secure said web section to at least one of said one or more side panels so as to hold the object placed between said platform portion and said web section, whereby the object is held securely between the web section and the upper surface of the platform portion when the side portions are folded in a direction away from the web section along said lines of articulation forming the sides of the platform thereby tightening the web section to deform and generally conform to the shape of the portion of the article contracting the web section against the object between the web section and the platform portion, wherein said web section is either in an overlap panel having a web section in a predefined tessellation pattern, said overlap panel being formed in said planar surface and said overlap panel having an attachment portion adapted to fold over said upper surface of said platform portion and to join said attachment portion to said panel opposite by folding said overlap portion; or aligned to overlie said planar surface.

2. An article of packaging of claim 1, wherein said platform portion is configured with a predefined tessellation pattern so as to hold the object when the side portions are folded in a direction away from the web portion.

3. An article of packaging of claim 1, wherein said platform portion is configured with a predefined extensible pattern so as to be extended by the object when the side portions are folded in a direction away from the web portion.

4. An article of packaging of claim 1, wherein said web section is configured with a predefined extensible pattern so as to be extended by the object when the side portions are folded in a direction away from the web portion.

5. An article of packaging of claim 1, wherein said planar structure is corrugated board with said web portion being formed from corrugated board.

6. An article of packaging of claim 1, wherein said planar structure is corrugated plastic, card board, twin-wall plastic, extruded twin-wall plastic-sheet products make-up to corrugated fiberboard with said web portion being formed from said corrugated plastic or any suitable semi rigid planar board material.

7. An article of packaging of claim 1, wherein said overlap panel comprising a film membrane having a web section in a predefined tessellation pattern.

8. An article of packaging of claim 1, wherein said film membrane is dense paper, semi rigid plastics, non-corrugate plastic, biodegradable paper, biodegradable plastics or suitable flexible film material.

9. An article of packaging of claim 1, wherein said one or more side panels have a predefined flap pattern defining at least one side retention flap contiguous with said platform portion.

10. An article of packaging of claim 1, wherein said one or more side panels have a predefined end brace pattern defining at least one end brace flap contiguous with said platform portion.

11. An article of packaging of claim 10, wherein said one or more side panels have a predefined end spacer pattern said at least one end spacing flap contiguous with said platform portion and said end brace flap.

12. An article of packaging of claim 1, wherein said one or more side panels have a predefined line of articulation pattern to permit said one or more side panels to be moved relative to the platform portion from an unfolded position to a folded position.

13. An article of packaging of claim 1, wherein said contiguous predefined pattern of said foldable member has a predefined crease pattern thereby creating compound joints and permitting said one or more side panels to be moved relative to the platform portion from an unfolded position to a folded position.

14. An article of packaging of claim 1, wherein said contiguous predefined pattern of said foldable member is a tensioning packaging article.

15. An article of packaging of claim 1, wherein said contiguous predefined pattern of said foldable member pattern is a container, box or enclosure.

16. An article of packaging of claim 1, wherein said contiguous predefined pattern of said foldable member pattern is a clam-shell insert for a container, box or enclosure.

17. An article of packaging of claim 1, wherein said contiguous predefined pattern of said foldable member pattern is clam-shell insert formed contiguous with a container, box or enclosure.

18. An article of packaging of claim 1, wherein said contiguous predefined pattern of said foldable member pattern is a hammock container, box or enclosure.

19. An article of packaging of claim 1, wherein said contiguous predefined pattern of said foldable member pattern is an insert packaging article.

20. An article of packaging of claim 19, wherein said contiguous predefined pattern of said foldable member pattern is an insert packaging article whereby multiple insert packaging articles can be disposed in a container.

21. An article of packaging of claim 1, wherein said upper surface of said planar structure is adapted with a friction coating laminate, application, or treatment functioning to improve friction and prevent slipping of the object.

22. An article of packaging of claim 1, wherein said predefined tessellation pattern of said web portion has HEXPAND formula of at least two nodes and a plurality of slits in a repeating pattern comprising:

a. a first node | 1 | having an approximate length dimension of 3× a slit width, b. a node width (NW) having an approximate dimension of 2× a slit width, c. a slit cross-leg length of approximately dimension of 2 plus (+) said slit width, d. a slit intermediary length of approximately dimension of 1 e. and a second node | 2 | in a pattern repeating.

23. An article of packaging of claim 1, wherein said predefined tessellation pattern of said web portion has HEXPAND formula of at least three nodes and a plurality of slits in a repeating pattern.

24. An article of packaging of claim 1, wherein said predefined tessellation pattern of said web portion has HEXPAND formula of at least four nodes and a plurality of slits in a repeating pattern.

25. An article of packaging of claim 1, wherein said construction is in one or more sub-pieces.

26. An article of packaging for holding an object securely, the packaging article comprising:

a foldable member, comprising:

a planar structure having an upper surface and a lower surface, a platform portion, one or more side panels contiguous to said platform portion, said one or more side panels having lines of articulation adapted to fold said one or more side panels to form sides of a platform of the article for packaging, and a web section in a predefined tessellation pattern, said web section adapted to fold a line of articulation between said web section and said platform portion to secure the object placed between said web section and said platform portion, said web section aligned to overlie said planar structure, said web section having an attachment portion adapted to secure said web section to at least one of said one or more side panels so as to hold the object placed between said platform portion and said web section, whereby the object is held securely in three-dimensions between said web section and said upper surface of said platform portion when said side portions are folded in a direction away from said web section along said lines of articulation forming the sides of the platform thereby tightening said web section to deform and generally conform to the shape of the portion of the article contracting the web section against the object between said web section and said platform portion;

whereby the object is held securely between the web section and the upper surface of the platform portion when the side portions are folded in a direction away from the web section along said lines of articulation forming the sides of said platform thereby tightening the web section to deform and generally conform to the shape of the portion of the article contracting the web section against the object between the web section and the platform portion.

27. An article of packaging of claim 26, wherein said web section is corrugate board or suitable semi rigid planar board material or in combination of suitable semi rigid planar board material.

28. An article of packaging of claim 26, wherein said web section is corrugate plastic.

29. An article of packaging of claim 26, wherein said web section is a film membrane.

30. An article of packaging of claim 26, wherein said platform portion is configured with a predefined tessellation pattern so as to hold the object when the side portions are folded in a direction away from the web portion.

31. An article of packaging of claim 26, wherein said platform portion is configured with a predefined extensible pattern so as to be extended by the object when the side portions are folded in a direction away from the web portion.

32. An article of packaging of claim 26, wherein said web section is configured in an overlap panel having a web section in a predefined tessellation pattern, said overlap panel being formed in said planar surface and said overlap panel having an attachment portion adapted to fold over said upper surface of said platform portion and to join said attachment portion to said panel opposite by folding said overlap portion or aligned to overlie said planar surface.

33. An article of packaging of claim 26, wherein said predefined tessellation pattern of said web portion has HEXPAND formula of at least two nodes and a plurality of slits in a repeating pattern comprising:

a. a first Node | 1 | having an approximate length dimension of 3× a slit width, b. a node width (NW) having an approximate dimension of 2× a slit width, c. a slit cross-leg length of approximately dimension of 2 plus (+) said slit width, d. a slit intermediary length of approximately dimension of 1, and e. a second node | 2 | in a pattern repeating.

34. An article of packaging of claim 26, wherein said predefined tessellation pattern of said web portion has HEXPAND formula of at least three nodes and a plurality of slits in a repeating pattern.

35. An article of packaging of claim 26, wherein said predefined tessellation pattern of said web portion has HEXPAND formula of at least four nodes and a plurality of slits in a repeating pattern.

36. An article of packaging of claim 26, wherein said planar structure is corrugated board with said web portion being formed from corrugated board.

37. An article of packaging of claim 26, wherein said planar structure is corrugated plastic, corriboard, twin-wall plastic or other extruded twin-wall plastic-sheet products make-up to corrugated fiberboard with said web portion being formed from said corrugated plastic.

38. An article of packaging of claim 26, wherein said overlap panel comprising a film membrane having a web section in a predefined tessellation pattern.

39. An article of packaging of claim 26, wherein said film membrane is dense paper, semi rigid plastics, non-corrugate plastic, biodegradable paper, biodegradable plastics or any suitable semi flexible planar material.

40. An article of packaging of claim 26, wherein said one or more side panels have a predefined flap pattern defining at least one side retention flap contiguous with said platform portion.

41. An article of packaging of claim 26, wherein said one or more side panels have a predefined end brace pattern defining at least one end brace flap contiguous with said platform portion.

42. An article of packaging of claim 41, wherein said one or more side panels have a predefined end spacer pattern said at least one end spacing flap contiguous with said platform portion and said end brace flap.

43. An article of packaging of claim 26, wherein said one or more side panel(s) have a predefined line of articulation pattern to permit said one or more side panels to be moved relative to the platform portion from an unfolded position to a folded position.

44. An article of packaging of claim 26, wherein said contiguous predefined pattern of said foldable member has a predefined line(s) of articulation pattern thereby creating compound joints and permitting said one or more side panels to be moved relative to the platform portion from an unfolded position to a folded position.

45. An article of packaging of claim 26, wherein said contiguous predefined pattern of said foldable member is a tensioning packaging article.

46. An article of packaging of claim 26, wherein said contiguous predefined pattern of said foldable member pattern is a container, box or enclosure.

47. An article of packaging of claim 26, wherein said contiguous predefined pattern of said foldable member pattern is a clam-shell insert for a container, box or enclosure.

48. An article of packaging of claim 26, wherein said contiguous predefined pattern of said foldable member pattern is clam-shell insert formed contiguous with a container, box or enclosure.

49. An article of packaging of claim 26, wherein said contiguous predefined pattern of said foldable member pattern is a hammock container, box or enclosure.

50. An article of packaging of claim 26, wherein said contiguous predefined pattern of said foldable member pattern is an insert packaging article.

51. An article of packaging of claim 45, wherein said contiguous predefined pattern of said foldable member pattern is an insert packaging article whereby multiple insert packaging articles can be disposed in a container.

52. An article of packaging of claim 1, wherein said upper surface of said planar structure is adapted with a friction coating laminate, application, or treatment functioning to improve friction and prevent slipping of the object.

* * * * *